US006624557B2

(12) United States Patent
Pyen et al.

(10) Patent No.: US 6,624,557 B2
(45) Date of Patent: Sep. 23, 2003

(54) CATHODE-RAY TUBE WITH REDUCED MOIRÉ EFFECT AND A PARTICULAR RATIO OF SCANNING PITCHES TO APERTURE PITCHES

(75) Inventors: Do-Hun Pyen, Cheonan (KR); Jong-Heon Kim, Seongnam (KR); Jung-In Yoo, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 272 days.

(21) Appl. No.: 09/770,674

(22) Filed: Jan. 29, 2001

(65) Prior Publication Data

US 2001/0017513 A1 Aug. 30, 2001

(30) Foreign Application Priority Data

Jan. 28, 2000 (KR) ..... 2000/4372

(51) Int. Cl.[7] ..... H01J 29/80
(52) U.S. Cl. ..... 313/403; 313/408
(58) Field of Search ..... 313/403, 408, 313/477 R

(56) References Cited

U.S. PATENT DOCUMENTS

| | | | | |
|---|---|---|---|---|
| 4,638,212 A | | 1/1987 | Nakamura | 313/408 |
| 5,055,736 A | | 10/1991 | Yun et al. | 313/402 |
| 5,378,959 A | * | 1/1995 | Mancini | 313/403 |
| 5,430,502 A | | 7/1995 | Yamazaki et al. | 348/806 |
| 5,534,746 A | | 7/1996 | Marks et al. | 313/408 |
| 5,606,216 A | | 2/1997 | Uchida et al. | 313/412 |
| 5,619,094 A | | 4/1997 | Vriens | 313/402 |
| 5,747,933 A | | 5/1998 | Beeteson et al. | 315/1 |
| 5,777,441 A | | 7/1998 | Yoshida et al. | 315/371 |
| 5,825,435 A | | 10/1998 | Vriens et al. | 348/841 |
| 5,841,247 A | * | 11/1998 | Vriens | 313/403 |
| 5,861,710 A | | 1/1999 | Uchida et al. | 313/440 |
| 5,959,414 A | | 9/1999 | Yoshida et al. | 315/382 |
| 6,531,812 B2 | * | 2/2003 | Ko | 314/403 |

* cited by examiner

*Primary Examiner*—Harshad Patel
(74) *Attorney, Agent, or Firm*—Robert E. Bushnell, Esq.

(57) ABSTRACT

Cathode-ray tubes with a shadow mask effective in minimizing the moiré effect are disclosed. The shadow mask has a plurality of apertures allowing electron beams to pass through, where a vertical pitch $P_y$ between each of the neighboring apertures along a minor axis of the shadow mask and a scanning pitch $P_s$ between each of the scan lines of the electron beams satisfy the following relations hip:

$$((2n+1)/4)-0.1 \leq P_s/P_y \leq ((2n+1)/4)+0.1$$

where n is an integer not less than three.

13 Claims, 3 Drawing Sheets

CATHODE-RAY TUBE WITH REDUCED MOIRÉ EFFECT AND A PARTICULAR RATIO OF SCANNING PITCHES TO APERTURE PITCHES

This application makes reference to, incorporates the same herein, and claims all benefits accruing under 35 U.S.C. §119 from an application entitled Cathode Ray Tube with Reduced Moiré earlier filed in the Korean Industrial Property Office on Jan. 28, 2000, and there duly assigned Serial No. 4372/2000 by that Office.

BACKGROUND OF THE INVENTION

1. Field of the Invention

The present invention relates to cathode-ray tubes (CRTs), and more particularly to color cathode-ray tubes of a type having shadow masks effective in minimizing the moiré effect.

2. Description of the Background Art

A predominant number of color cathode-ray tubes in use today have shadow masks that include apertures of a circular type or a slot-shaped type. The apertures are aligned in columns along the minor axis of the shadow mask, or in a vertical direction, and the adjacent apertures in each column are separated from each other by bridges.

When the electron beams scan in an interlacing mode or a progressive mode, they also have scanning pitches. A scanning pitch is the distance between adjacent scanning lines. Since the apertures in the shadow mask as well as the scan lines are periodic, the electron beams that pass through each aperture interfere with each other to cause a disturbing effect which is the so-called moiré effect. This effect causes light and dark lines or lines of a deviating color in the image to deteriorate the qualities of the display images.

To overcome the moiré effect, a number of solutions have been proposed. For example, the vertical pitches of the apertures may be adjusted when designing a shadow mask. That is, since it is well known that the moiré effect seldom occurs when the wavelengths of moiré patterns are less than 2 mm (millimeters), the aperture pitches can be designed to minimize the moiré.

However, the proposals to minimize the moiré effect are mainly developed for cathode-ray tubes such as television receivers with a NTSC (National Television System Committee) or PAL (phase alternation line) system. Efforts for eliminating the moiré effect have not been developed for cathode-ray tubes such as high-definition television (HDTV) systems. High-definition televisions generally have higher picture resolution than the PAL or NTSC systems.

Exemplars of the art are U.S. Pat. No. 5,861,710 issued to Uchida et al. for Color Cathode Ray Tube with Reduced Moire, U.S. Pat. No. 5,959,414 issued to Yoshida et al. for Moire Reducing Apparatus, U.S. Pat. No. 5,247,933 issued to Beeteson et al. for Moire Interference Detection for Raster-Scanned Cathode Ray Tube Display, U.S. Pat. No. 5,430,502 issued to Yamazaki et al. for Apparatus for Eliminating Moire Pattern Effects Resulting from the Use of Different Display Resolution with a Fixed Size Shadow Mask, U.S. Pat. No. 5,777,441 issued to Yoshida et al. for Moire Reducing Apparatus, U.S. Pat. No. 5,619,094 issued to Vriens for Color Cathode Ray Tube and Display Device with Reduced Moire, U.S. Pat. No. 5,606,216 issued to Uchida et al. for Color Cathode-Ray Tube with Reduced Moire, U.S. Pat. No. 4,638,212 issued to Nakaimura for Color Cathode-Ray Tube, U.S. Pat. No. 5,378,959 issued to Mancini for Shadow Mask Type Color Picture Tube with Reduced Moire, U.S. Pat. No. 5,055,736 issued to Yun et al. for Shadow Mask for Use in a Three-Gun Color Picture Tube, U.S. Pat. No. 5,841,247 issued to Vriens for Cathode Ray Tube Display System Incorporating Same and Computer Including Control Means for Display System, U.S. Pat. No. 5,825,435 issued to Vriens et al. for Color Cathrode Ray Tube and Display Device, and U.S. Pat. No. 5,534,746 issued to Marks et al. for Color Picture Tube Having Shadow Mask with Improved Aperture Spacing.

SUMMARY OF THE INVENTION

In view of the prior art described above, it is an object of the present invention to provide a cathode-ray tube for high-definition televisions having a shadow mask that is capable of minimizing the moiré effect due to the relation between a scanning pitch of the electron beams and a vertical pitch of the apertures in the shadow mask.

It is another object to provide a cathode-ray tube that decreases image distortion while providing higher resolution of the image.

It is yet another object to provide a device for displaying variable images that is manufactured according to a predetermined relationship between apertures in a shadow mask as well as the scan lines in order to reduce deterioration of the image because of light and dark lines or lines of a deviating color in the image.

It is still yet another object to have a device for displaying variable images that can decrease image distortion and yet increase the image resolution.

To achieve this object, a device includes a panel, a phosphor screen being arranged on an inner surface of the panel, a funnel connected to the panel, having a deflection yoke assembly on an outer periphery thereof, a neck connected to the funnel, having an electron gun assembly disposed therein, and a shadow mask disposed inside the panel, the shadow mask having a plurality of apertures allowing electron beams to pass through.

A vertical pitch $P_y$ between each of the neighboring apertures along a minor axis of the shadow mask and a scanning pitch $P_s$ between each scan line of the electron beams satisfy the following relationship:

$$((2n+1)/4)-0.1 \leqq P_s/P_y \leqq ((2n+1)/4)+0.1$$

where n is an integer not less than three.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
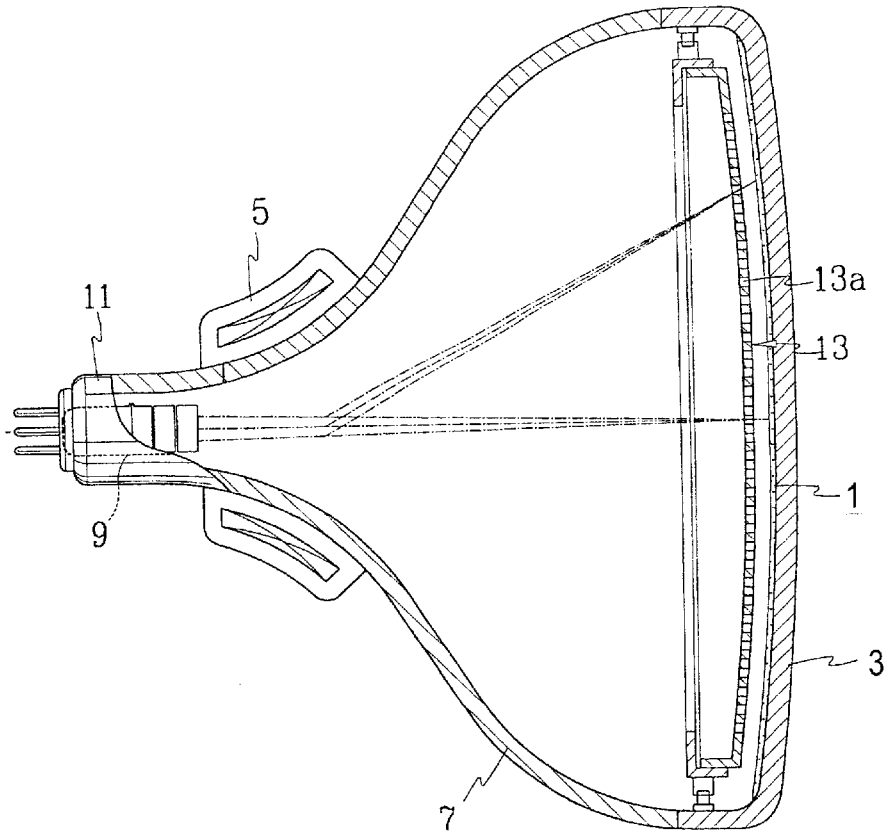
FIG. 1 shows a cathode-ray tube according to a preferred embodiment of the present invention.

Turning now to the drawings, in FIG. 1, a color cathode-ray tube according to a preferred embodiment of the present invention includes a highly evacuated envelope including a funnel 7 closed at one end by a panel 3 and at the opposite end continuing to a generally cylindrical neck 11. The neck 11 has an electron gun assembly 9 accommodated therein for emitting electron beams. The panel 3 has an inner surface deposited with a predetermined pattern of primary color elemental phosphor deposits, for example, triads of red, blue and green phosphor dots, thereby forming a phosphor screen 1. The envelope has a deflection yoke assembly 5 mounted thereon at the boundary between the neck 11 and the funnel 7 for developing a horizontal deflection magnetic field and a vertical deflection magnetic field.

Figure 2:
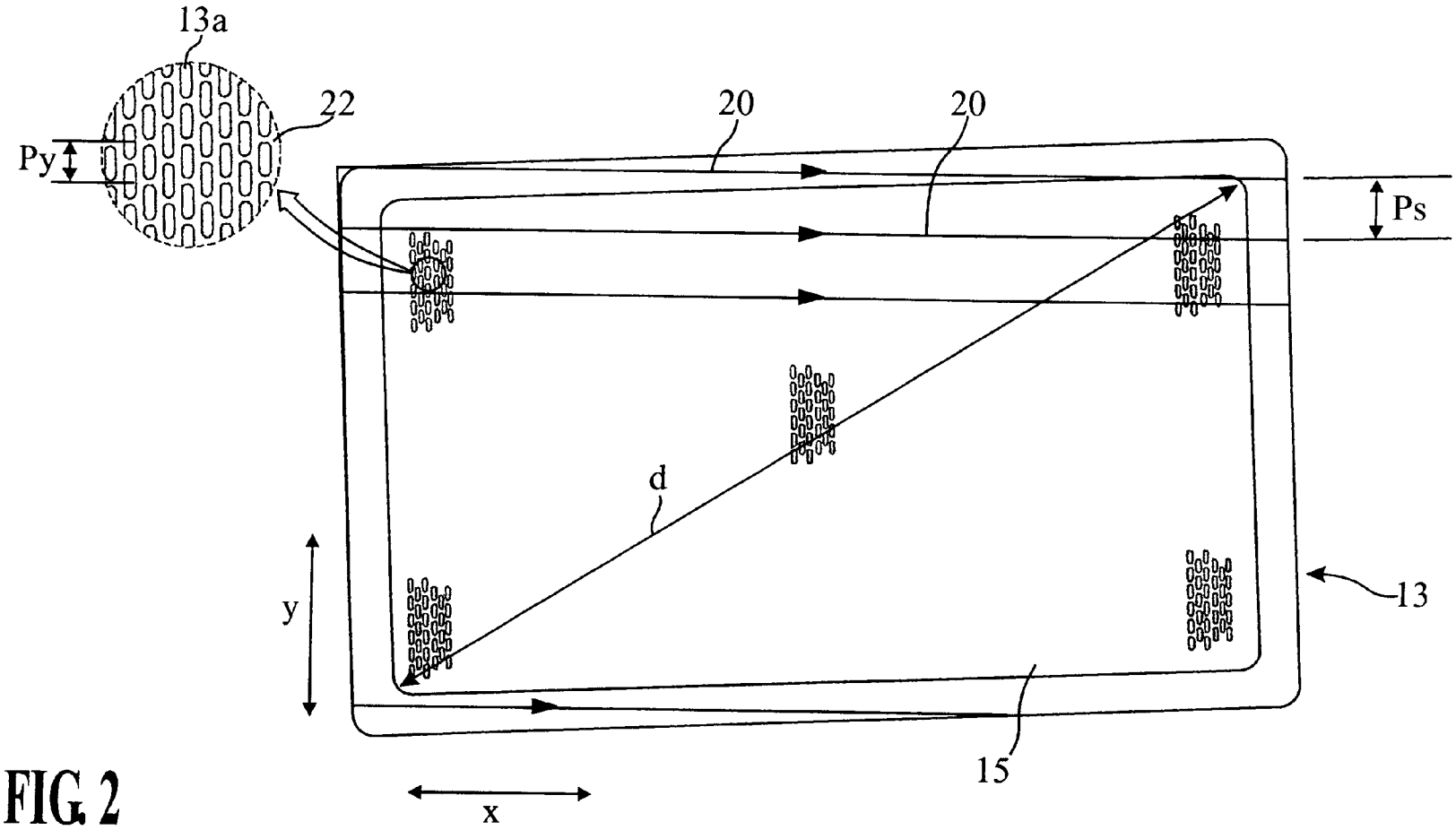
FIG. 2 is a schematic view illustrating a relation between a vertical pitch of the apertures in a shadow mask and a scanning pitch of the electron beams, according to the preferred embodiment of the present invention.

A shadow mask 13, which is supported in the panel 3, has a plurality of apertures 13*a* for allowing the electrons to pass through in a predetermined pattern. The apertures are slot-shaped as shown in FIG. 2, having a constant vertical pitch $P_y$ in a minor axis y of the shadow mask. In FIG. 2, adjacent scan lines 20 are shown to have a scanning pitch of $P_s$.

In this construction, the electron beams emanating from the electron gun assembly 9 travel toward the phosphor screen 1. During the travel of the electron beams S towards the phosphor screen 1, the electron beams are deflected by the deflection yoke assembly 5 so as to scan the phosphor screen 1. Thereby the phosphor materials on the phosphor screen 1 emit fluorescence upon the electron beams to display color images in the cathode-ray tube.

The cathode-ray tube according to the preferred embodiment has an aspect ratio of 16:9 and a diagonal dimension "d" of more than 750 mm (millimeters) in an effective display area 15 in the panel 1.

The phosphor screen 1 is generally scanned in an interlacing mode, and the scan lines have a constant scan pitch $P_s$ on the screen 1. The present invention is adapted for the high-definition television so that the number of scan lines is higher than 1000 with a field frequency of 60 Hz (hertz). The number of scan lines is set to be 1125 in the preferred embodiment.

Since the shadow mask 13 of the cathode-ray tube also has bridges 22 between each aperture in a column, the moiré effect will occur due to the interference between the scanning pitches of the electron beams and the aperture pitches of the shadow mask. To minimize the moiré effect, the following feature of the cathode-ray tube 13 has been devised.

The cathode-ray tube is constructed having the ratio of the scanning pitches $P_s$ of the electron beam to the aperture pitches $P_y$ of the shadow mask satisfy the following condition:

$$((2n+1)/4)-0.1 \leqq P_s/P_y \leqq ((2n+1)/4)+0.1$$

where n is an integer not less than three ($n \geqq 3$).

The above feature of the present invention is conceived on the basis of the fact that the cathode-ray tubes for NTSC or PAL systems have the following characteristics as shown in Tables 1 through 2.

TABLE 1

| Types of Cathode-ray tubes (diagonal dimension) | Vertical pitch $P_y$ (mm) | Television system | Moiré effect |
|---|---|---|---|
| 29 inches | 0.63 | NTSC | Good |
| | | PAL | Not good |
| | 0.59 | NTSC | Not good |
| | | PAL | Very good |
| 25 inches | 0.69 | NTSC | Not good |
| | | PAL | |
| | 0.91 | NTSC | Not good |
| | | PAL | |
| | 0.57 | NTSC | Very good |
| | | PAL | Not good |

TABLE 2

| Types of Cathode-ray tubes (diagonal dimension) | Vertical pitch $P_y$ (mm) | Television system | Wavelength of Moiré pattern λ (mm) | |
|---|---|---|---|---|
| 29 inches | 0.63 | NTSC | 3.6 (n = 5) | 3.0 (n = 6) |
| | | PAL | 2.4 (n = 4) | 3.3 (n = 5) |
| | 0.59 | NTSC | 2.0 (n = 5) | Large (n = 6) |
| | | PAL | 1.5 (n = 4) | Large (n = 5) |
| 25 inches | 0.69 | NTSC | 4.2 (n = 4) | 2.5 (n = 5) |
| | | PAL | | |
| | 0.91 | NTSC | 5.3 (n = 3) | 2.0 (n = 4) |
| | | PAL | | |
| | 0.57 | NTSC | 4.8 (n = 5) | 1.9 (n = 6) |
| | | PAL | 2.7 (n = 4) | 2.2 (n = 5) |

Table 1 represents moiré effects for cathode-ray tubes (25 inches, 29 inches diagonal dimension) in the NTSC or PAL systems. In the right column "moiré effect" of the table, "very good" means that the moiré effect hardly occurs, "good" means that the moiré effect occurs a little, and "not good" means that the moiré effect occurs a great deal. Table 2 represents moiré wavelengths λ for Table 1, which are calculated by the following equation:

$$\lambda=1/|(2/P_y)-(n/2S)| \text{ for an interlacing mode.}$$

where $P_y$ is a vertical pitch of the apertures in the shadow mask; S is a scanning pitch of the electron beams; and n is an integer.

In the meantime, a moiré wavelength for a progressive mode is calculated by the following equation:

$$\lambda=1/|(2/P_y)-(n/S)| \text{ for a progressive mode.}$$

Comparing Table 1 with Table 2, when "n" is an odd number, the moiré wavelength becomes large. When "n" is an even number, the moiré wavelength becomes less than 2 millimeters so that the calculated moiré wavelengths in Table 2 are consistent with the moiré effect in Table 1.

Assume for example, a 25 inches diagonal dimension cathode-ray tube of the NTSC system being in an even "n" mode. When the vertical pitch $P_y$ is 0.91 mm (millimeters), the moiré effect is "not good" (n=4). In contrast, when the vertical pitch $P_y$ is 0.57 mm, the moiré effect is "very good" (n=6).

Figure 3:
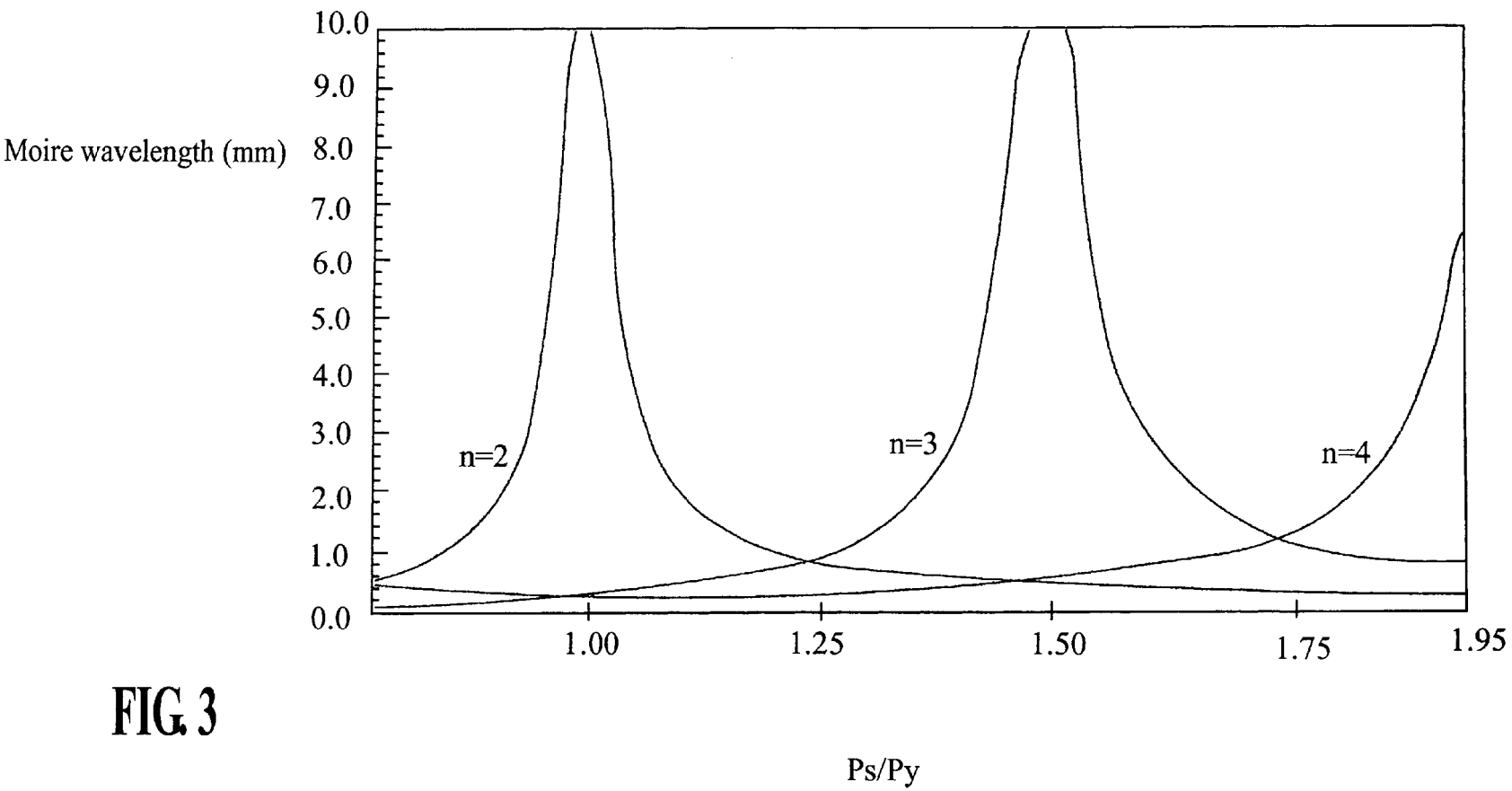
FIG. 3 is a diagram showing a relation between a moiré wavelength and a ratio of the vertical pitch of the apertures to the scanning pitch of the electron beams, according to the preferred embodiment of the present invention.

Therefore, it has been noted that the smaller the vertical pitches of the aperture, the less moiré patterns occur when the integer n is even as well as large, in both the NTSC or PAL systems. When the television system is a high-definition television system, the present invention can be applied to design shadow masks to satisfy the above features. Referring to FIG. 3, a detailed explanation will be provided.

FIG. 3 is a diagram showing a relation between a moiré wavelength and a ratio $P_s/P_y$ of the vertical pitch of the apertures to the scanning pitch of the electron beams. In the drawing, the horizontal axis represents the ratio $P_s/P_y$ and the vertical axis represents the moiré wavelength λ given in millimeters.

As shown in FIG. 3, the cathode-ray tubes for high-definition television systems according to the present invention have a good moiré effect when the integer n is 4 such that the moiré wavelength λ becomes less than 2 millimeters. The ratio $P_s/P_y$ preferably has a range from 1.65 to 1.85, and the ratio is most preferably selected as 1.75.

In the NTSC or PAL system, it is desirable to select the integer "n" to be large, such as over six. However, when the integer n is six, the ratio $P_s/P_y$ is also increased in the high-definition television system. The large ratio $P_s/P_y$ means that the vertical pitch $P_y$ is small, so that the bridges 22 in the shadow mask may be excessively small. Therefore, the integer "n" is preferably determined by considering the strength of the shadow mask as well as the moiré effect. As explained above, the present invention provides cathode-ray tubes with a shadow mask having optimized vertical pitch to be capable of minimizing the moiré effect.

It should be noted that the present invention may apply to a cathode-ray tube in a progressive mode, as well as in an interlacing mode which has been described above. It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A cathode-ray tube, comprising:

a panel with a phosphor screen being arranged on an inner surface of the panel;

a funnel connected to the panel, the funnel having a deflection yoke assembly on an outer periphery of the funnel;

a neck connected to the funnel, the neck having an electron gun assembly disposed therein; and a shadow mask disposed inside the panel, the shadow mask having a plurality of apertures allowing electron beams to pass through, a vertical pitch $P_y$ between each of the neighboring apertures along a minor axis of the shadow mask and a scanning pitch $P_s$ between each scan line of the electron beams satisfy the following relationship:

$$((2n+1)/4)-0.1 \leqq P_s/P_y \leqq ((2n+1)/4)+0.1$$

where n is an integer having a value of at least three.

2. The cathode-ray tube of claim 1, with the number of scan lines of the electron beams in the phosphor screen being more than 1000.

3. The cathode-ray tube of claim 2, with a field frequency of the electron beams in the screen being 60 hertz.

4. The cathode-ray tube of claim 3, with the diagonal dimension of an effective screen in the screen being more than 750 millimeters.

5. The cathode-ray tube of claim 1, with a field frequency of the electron beams in the screen being 60 hertz.

6. The cathode-ray tube of claim 5, with the diagonal dimension of an effective screen in the screen being more than 750 millimeters.

7. The cathode-ray tube of claim 1, with the diagonal dimension of an effective screen in the screen being more than 750 millimeters, the effective screen being a viewable area of the screen.

8. An apparatus, comprising a shadow mask having a plurality of apertures, the shadow mask having a vertical pitch $P_y$ between each of the neighboring apertures along a minor axis of the shadow mask and a scanning pitch $P_s$ between each scan line of the electron beams satisfy the following relationship:

$$((2n+1)/4)-0.1 \leqq P_s/P_y \leqq ((2n+1)/4)+0.1$$

where n is an integer having a value of at least three.

9. The apparatus of claim 8, with the number of scan lines of the electron beams in the phosphor screen being more than 1000.

10. The apparatus of claim 9, with a field frequency of the electron beams in the screen being 60 hertz.

11. The apparatus of claim 10, with the diagonal dimension of an effective screen in the screen being more than 750 millimeters, the effective screen being a viewable area of the screen.

12. The apparatus of claim 8, with a field frequency of the electron beams in the screen being 60 hertz.

13. The apparatus of claim 8, with the diagonal dimension of an effective screen in the screen being more than 750 millimeters, the effective screen being a viewable area of the screen.

* * * * *